US007254921B2

(12) United States Patent
Osmun et al.

(10) Patent No.: US 7,254,921 B2
(45) Date of Patent: Aug. 14, 2007

(54) ROCKING HINGE BEARING SYSTEM FOR ISOLATING STRUCTURES FROM DYNAMIC/SEISMIC LOADS

(76) Inventors: Richard Lee Osmun, P.O. Box 24943, Denver, CO (US) 80224; Nien-Yin Chang, 6551 S. Billings Way, Englewood, CO (US) 80111; Shingchun Trever Wang, 447 S. Youngfield Ct., Lakewood, CO (US) 80228

( * ) Notice: Subject to any disclaimer, the term of this patent is extended or adjusted under 35 U.S.C. 154(b) by 0 days.

(21) Appl. No.: 11/231,420

(22) Filed: Sep. 21, 2005

(65) Prior Publication Data

US 2006/0013516 A1 Jan. 19, 2006

Related U.S. Application Data

(63) Continuation of application No. 10/271,359, filed on Oct. 15, 2002, now abandoned.

(51) Int. Cl.
*E04B 1/98* (2006.01)

(52) U.S. Cl. ..... 52/167.1; 52/167.8; 248/560; 248/580

(58) Field of Classification Search ..... 52/167.6, 52/167.8, 167.1; 248/560, 562, 568, 575, 248/580

See application file for complete search history.

(56) References Cited

U.S. PATENT DOCUMENTS 2,690,074 A 9/1954 Jones
2,708,560 A 5/1955 Paley
3,245,646 A 4/1966 Baratoff
4,076,195 A 2/1978 Uhler
4,638,609 A 1/1987 Csak
4,718,206 A 1/1988 Fyfe et al.
4,744,539 A 5/1988 Stimeling
5,669,189 A 9/1997 Logiadis et al.

OTHER PUBLICATIONS

Priestley, et al, "Seismic Response of Precast Prestressed Concrete Frames with Partially Debonded Tendons", PCI Journal, Jan.-Feb. 1993, pp. 58-69.
Priestley, et al, "Seismic Tests of Precast Beam-to-Column Joint Subassemblages with Unbonded Tendons", PCI Journal, Jan.-Feb. 1996, pp. 64-81.
Cheok, et al, "Seismic Response of Precast Concrete Frames with Hybrid Connections", ACI Structural Journal, Sep.-Oct. 1998, pp. 527-539.
El-Sheikh, et al, "Seismic Behavior and Design of Unbonded Post-Tensioned Precast Concrete Frames", PCI Journal, May-Jun. 1999, pp. 54-71.

(Continued)

*Primary Examiner*—William C. Joyce
(74) *Attorney, Agent, or Firm*—Emery L. Tracy

(57) ABSTRACT

A rocking hinge bearing system is provided. The rocking hinge bearing system comprises a first base plate, a second base plate, and a compressible member. A pintle mechanism is required to align the first base plate, the second base plate and the compressible member and to prevent relative horizontal movement between the first base plate, the second base plate and the compressible member. A tensioning mechanism inhibits axial separation of the first base plate relative to the second base plate and helps to return the first base plate into its original position relative to the second base plate after rocking.

12 Claims, 4 Drawing Sheets

OTHER PUBLICATIONS

El-Sheikh, et al, "Moment Rotation Behavior of Unbonded Post-Tensioned Precast Concrete Beam-Column Connections", ACI Structural Journal, Jan.-Feb. 2000, pp. 122-131.

"SPECIAL Hybrid Moment Frames Composed of Discretely Jointed Precast and Post-Tensioned Concrete Members (ACI 1.2-XX) and Commentary (T1.2R-XX)", ACI Structural Journal, Sep.-Oct. 2001, pp. 771-785.

Mander, et al, "Replaceable Hinge Detailing for Bridge Columns", Seismic Response of Concrete Bridges, pp. 185-284.

Pekan, et al., "Experiments on Steel MRF Building with Supplemental Tendon System", Journal of Structural Engineering, Apr. 2000, pp. 437-444.

Pekan, et al, "Balancing Lateral Loads using Tendon-Based Supplemental Damping System", Journal of Structural Engineering, Aug. 2000, pp. 896-905.

Madan, et al, "Hysteretic Behavior of Concrete Masonry Shear Walls with Unbonded Reinforcement", TMS Journal, Jul. 2000, pp. 31-63.

‡ = Cap Beam Motion

ROCKING HINGE BEARING SYSTEM FOR ISOLATING STRUCTURES FROM DYNAMIC/SEISMIC LOADS

The present application is a continuation of patent application Ser. No. 10/271,359, filed on Oct. 15, 2002, now abandoned entitled "Rocking Hinge Bearing System for Isolating Structures from Seismic Ground Motions".

BACKGROUND OF THE INVENTION

1. Field of the Invention

This invention relates generally to bearing systems which isolate structures from motions produced by dynamic loads and, more particularly, it relates to a rocking hinge bearing system which inhibits instability of the structure when subjected to dynamic loads including seismic, wind, vehicle impact, or all other transient loads.

2. Description of the Prior Art

Bents for structural frames usually consist of a cap beam supported by multiple columns or a single pier wall to resist lateral loads transversely (in the plane of the bent) and longitudinally (perpendicular to the plane of the bent). Pier walls are stiffer in the transverse direction because they act as shear walls in that direction. Likewise, multiple column bents are generally stiffer in the transverse direction because the frame action in the plane of the bent is usually more rigid than the longitudinal frame action.

In the past, many devices have been created to soften dynamic excitation by either isolating the structure from the force of dynamic excitation or dissipating and absorbing energy. Included among these devices are laminated elastomeric bearings which typically consist of rubber or resilient pads laminated between steel shims. While the laminated elastomeric bearings support the axial load of the structure and will, to some extent, attenuate the motion of the structure, these bearings are too flexible and have a low shearing resistance which limits their ability to take large lateral loads without displaying excessive horizontal deflections or failing in shear.

Another type of device to soften dynamic excitation is laminated lead-rubber bearings. The laminated lead-rubber bearings are similar to the laminated elastomeric bearings except that the laminated lead-rubber bearing has a lead core to stiffen the horizontal movement of the bearing and to better maintain the integrity of the resilient pads. However, the lead core reduces the opportunity for the bearing to recenter itself after being subjected to a horizontal load because the remaining inertial or static forces within the structural system may not be large enough to deform the lead core back to its original configuration.

Other types of bearings include friction pendulum bearings, steel hysteretic dampers, hydraulic dampers, and lead or rubber extrusion dampers. From an economic viewpoint, it is desirable to avoid the use of bearings by using monolithic construction that incorporates columns that are capable of developing plastic hinges where they connect to the rest of the structure. Unfortunately, conventional plastic hinge columns are only average performers in both hard soils/rocks and soft soils whereas some of the seismic isolation bearings have a clear advantage in either hard soils/rocks or soft soils. In particular, lead rubber bearings seem to have a clear advantage in soft soils but under perform in hard soils/rocks. Hence, the indiscriminate use of seismic isolation devices can lead to reduced performance.

Accordingly, there exists a need for bearing systems with natural recentering capabilities which can isolate structures from ground motions produced by dynamic loads. Additionally, a need exists for a structurally stable bearing system that can limit the moment transfer from a column to its supports in order to reduce structural damage as the structure rocks during a dynamic excitation.

SUMMARY

The present invention is a bearing assembly for supporting a structure with the structure having a first support in a first position relative to a second support. The bearing assembly comprises a first base plate mounted to the first support of the structure with the first base plate having a first aperture and a second base plate mounted to the second support of the structure with the second base plate having a second aperture. The first aperture of the first base plate is alignable with the second aperture of the second base plate. A compressible member is positioned between the base plates with the compressible member having a member aperture alignable with the first aperture and the second aperture. A pintle having a pintle aperture is mounted within the first aperture, the second aperture, and the member aperture. Tensioning means extend through the pintle aperture for tensioning the first support to the second support in the first position and after rocking of the first support relative to the second support, both supports return to the first position.

The present invention includes the mechanism for resisting relative lateral displacements. The rocking hinge bearing system comprises a first plate, a second plate and a mechanism between the first plate and the second plate to inhibit lateral or rolling movements of the first plate relative to the second plate. Furthermore, a tensioning mechanism inhibits separation of the first plate relative to the second plate and returns the first plate to a predetermined position relative to the second plate.

The present invention further includes a method for returning a structure to an original position subsequent to a rocking event with the structure having at least a first level connected to a second level. The invention comprises tensioning the first level in a first position relative to the second level. Under dynamic excitation, the first level moves to a second position relative to the second level, and returns the first level to the first position relative to the second level.

DETAILED DESCRIPTION OF THE PREFERRED EMBODIMENTS

Figure 2:
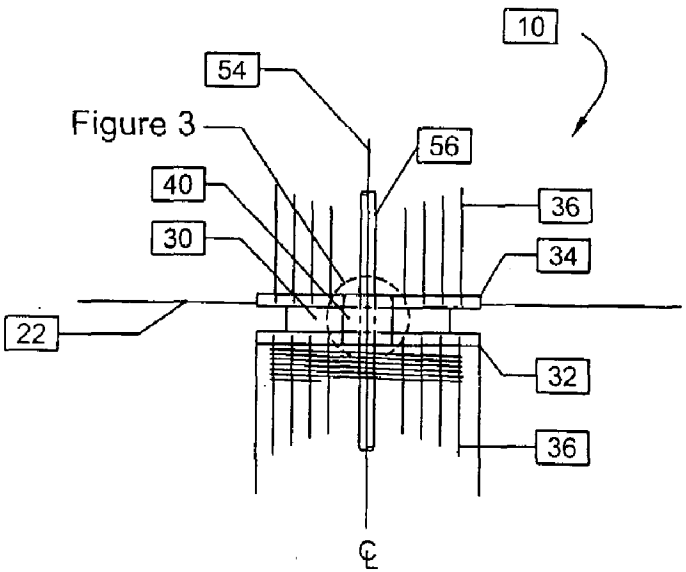
FIG. 2 is an enlarged view illustrating the rocking hinge bearing system of FIG. 1, constructed in accordance with the present invention.
Figure 1:
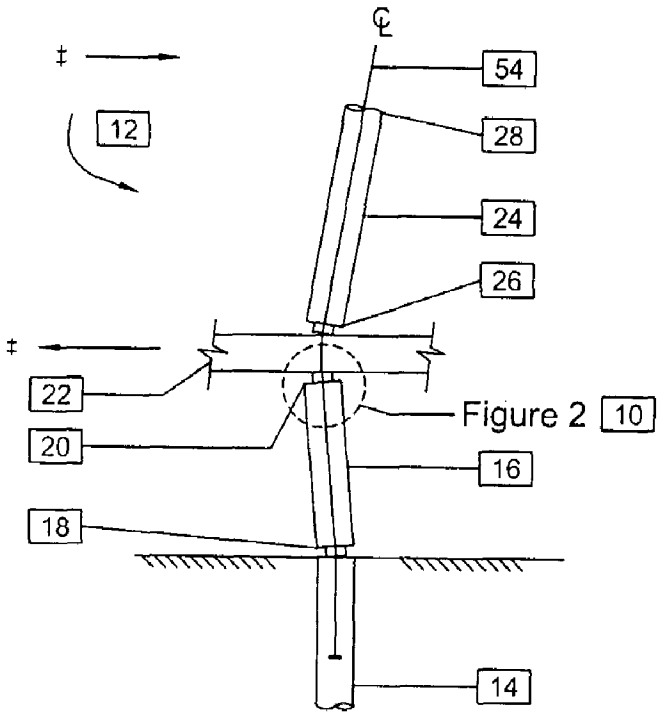
FIG. 1 is an elevation view illustrating rocking columns fitted with rocking hinge bearings, constructed in accordance with the present invention.
Figure 3:
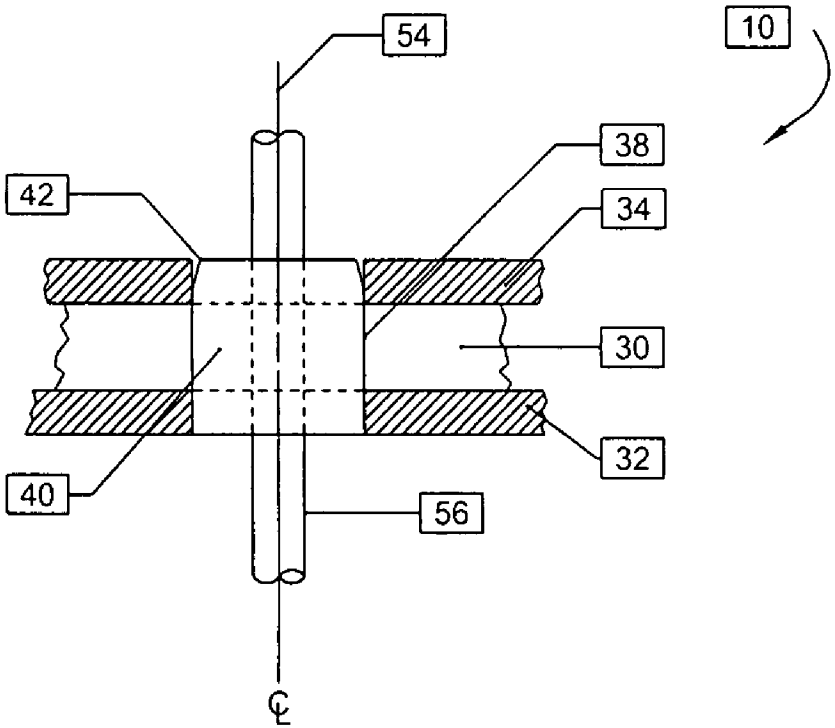
FIG. 3 is a further enlarged view illustrating the rocking hinge bearing system of FIG. 1, constructed in accordance with the present invention.

As illustrated in FIGS. 1-3, the present invention is a rocking hinge bearing, indicated at 10, which inhibits the collapse of a structure 12 during a dynamic event due to any overturning moments created by the rocking of the structure 12. The structure 12 can be any type of structure including, but not limited to, buildings, bridges, structural frames, walls, towers, antenna, etc.

The structure 12, for purposes of discussion, includes a caisson (foundation) 14, a first column 16 having a first end 18 and a second end 20 with the first end 18 being connected to the caisson (foundation) 14, a cap beam (or a properly reinforced floor slab) 22 connected to the second end 20 of the first column 16, and a second column 24 having a first end 26 and a second end 28 with the first end 26 being connected to the cap beam 22. A person skilled in the art will understand that the structure 12 can include more than one caisson (foundation) 14, more than two columns 16, 24 stacked upon each other, and more than one cap beam 22 between each of the stacked columns and should not be limited by the number of caissons (foundations) 14, columns 16, 24, and cap beams 22 described herein. The rocking hinge bearings 10 of the present invention can be positioned at each of the connections, or any number of the connections, to achieve the desired result.

The rocking hinge bearing 10 of the present invention has numerous advantages including, but not limited to, inhibiting instability of the structure 12 during rocking, limiting connection movements developed during rocking of the structure, and resisting collapse of the structure 12 during dynamic events. The unique advantages and other novel features of the rocking hinge bearing 10 will now be described in detail.

As illustrated in FIGS. 1 and 2, the rocking hinge bearing 10 of the present invention includes a mild, compressible member 30 sandwiched between two hard, high strength steel base plates, namely a first (lower) base plate 32 and a second (upper) base plate 34. The first base plate 32 and the second base plate 34 are secured about each connection between the caisson (foundation) 14 and the first column 16, the first column 16 and the cap beam 22, and the cap beam 22 and the second column 24. For instance, the first base plate 32 is secured to the caisson (foundation) 14 and the second base plate 34 is secured to the first end 18 of the first column 16 with the compressible member 30 sandwiched therebetween. Likewise, the first base plate 32 is secured to the second end 20 of the first column and the second base plate 34 is secured to the cap beam 22 with the compressible member 30 sandwiched therebetween, etc. Securement of the first base plate 32 and the second base plate 34 to adjacent supporting members 14, 16, 22, and 24 can be accomplished by connecting the first base plate 32 and the second base plate 34 to the rebar within the caissons (foundations) 14, the rebar in first column 16, the rebar in cap beam 22, and the rebar in second column 24.

The relative size of the compressible member 30 as shown in FIGS. 2 and 3 can be used to control the magnitude of the column moments that are generated during a rocking event. Furthermore, the shape of the compressible member 30 can be used to control the relative magnitudes of the column moments about different compass lines. For instance, the compressible member 30 having a substantially circular interface configuration will produce the same relative moments about all compass lines while a compressible member 30 having a substantially elliptical interface configuration will produce different relative moments about different compass lines. Also, it is within the scope of the present invention for the interface configuration of the compressible member to be the same as the cross-sectional configuration of the supporting members 14, 16 or 24, as shown in FIG. 1.

Furthermore, the compressible member 30 is constructed from a single piece of A36 steel material. The A36 steel material is a very ductile carbon steel which is rolled in heats up to eight (8") inches and greater in thickness. While the compressible member 30 has been described as being formed from an A36 steel material, it is within the scope of the present invention, however, to form the compressible member 30 from other materials including, but not limited to, other types of metallic materials, plastic materials, etc. Constructing the compressible member 30 from a non-corrosive material provides a longer life for the compressible member 30, especially in humid climates. The same can be said for the other members in a rocking hinge bearing.

Furthermore, it should be noted that the compressible member 30 can be split into two or more parts so long as when assembled, the compressible member 30 has a configuration to create the desired column moments about any compass line. By splitting the compressible member 30, the compressible member 30 can be removed for repair and/or replacement without removal of the base plates 32, 34 or other components of the rocking hinge bearing 10.

As described above, the first base plate 32 and the second base plate 34 are formed or otherwise mounted into the concrete caissons (foundations) 14, columns 16, 24, or cap beams 22 of the structure 12. The first base plate 32 and the second base plate 34 preferably have a configuration that is larger than the configuration for the compressible member 30. The first base plate 32 and the second base plate 34 are constructed from an A514 steel material which is a quenched and tempered alloy rolled in heats up to six (6") inches thick. While the first base plate 32 and the second base plate 34 have been described as being formed from an A514 steel material, it is within the scope of the present invention, however, to form the first base plate 32 and the second base plate 34 from other materials including, but not limited to, other types of metallic materials, plastic materials, etc. Furthermore, preferably, regardless of the material used to form the first base plate 32 and the second base plate 34, the first base plate 32 and the second base plate 34 have a Brinell hardness greater than the Brinell hardness of the compressible member 30.

Since the ability of the rocking hinge bearing system 10 of the present invention depends in part on the shear friction between each of the base plates 32, 34 and the members to which they are attached (14, 16, 22 and 24), the diameter of the base plates 32 and 34 must be large enough to engage the member rebar 36. Enough of the member rebar 36 should be attached to each of the first base plate 32 and the second base plate 34 to create a uniform frictional resistance even though the axial load alone might be able to provide sufficient normal load to satisfy the shear friction requirements.

As illustrated in FIG. 2, the first base plate 32 has a diameter substantially equal to the diameter of the second base plate 34 although it is within the scope of the present invention to have the diameter of the first base plate 32 greater than or less than the diameter of the second base plate 34. Furthermore, preferably the diameter of the first base plate 32 and the second base plate 34 is greater than the diameter of the compressible member 30 although it is within the scope of the present invention to have the diameter of the first base plate 32 and the second base plate 34 be less than or equal to the diameter of the compressible member 30.

The inventors of the rocking hinge bearing 10 of the present invention have determined that having a substantially elliptical or circular compressible member 30, provides a distinct advantage over other shapes including, but not limited to, square, rectangular, triangular, etc. The first base plate 32 and second base plate 34 compressing and otherwise acting upon a substantially elliptical or circular compressible member provides equal stability and increased bearing area in all directions regardless of the direction of the force from the dynamic event.

Both the first base plate 32 and the second base plate 34 and the compressible member 30 have a substantially circular opening 38 formed therethrough. The rocking hinge bearing 10 of the present invention further includes a pintle member 40 mounted within the openings 38 of the base plates 32, 34 and the compressible member 30 and press-fit to the first base plate 32 or the second base plate 34. Other forms of securement of the pintle member 40 to either the first base plate 32 or the second base plate 34, such as threading, however, are within the scope of the present invention. The pintle member 40 prevents the base plates 32, 34 and the compressible member 30 from rolling out of position relative to each other and to resist shear force created during a dynamic event or generated by any other lateral or gravity loads.

As illustrated in FIG. 3, the pintle member 40 includes a taper 42 about the end of the pintle member 40 that is not press-fit. The taper 42 of the pintle member 40 allows the base plate 34 adjacent to the taper 42 to move about the pintle member 40 without binding up.

The size of the pintle member 40 is determined by the horizontal capacity of the adjacent supporting member, i.e., caisson (foundation) 14 or columns 16 and 24 less the frictional resistance on the steel interface using the minimum anticipated column reaction multiplied by the coefficient of friction of steel on steel. The pintle member 40 between the base plate 32 and the compressible member 30 could be fabricated from AISI 1040 steel or AISI 1045 steel hot rolled rounds. The AISI 1040 or AISI 1045 steel material is a medium carbon steel which is rolled in heats up to twenty-four (24") inches in diameter.

Figure 4:
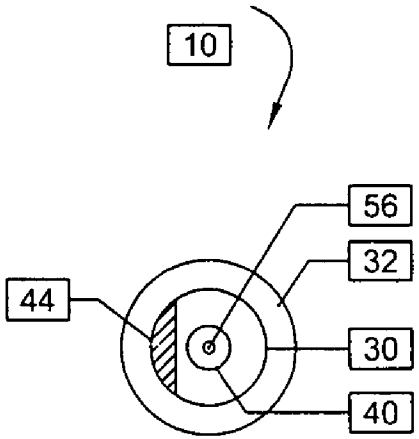
FIG. 4 is a top plan view illustrating the rocking hinge bearing system of FIG. 1, constructed in accordance with the present invention, with the bearing area during rocking being shown with hatch markings.

During rocking, the compressible member 30 is essentially cold formed by the high strength first and second base plates 32, 34 acting upon the compressible member 30. As illustrated in FIG. 4, the shape of the interface between the compressible member 30 and the first base plate 32 and the second base plate 34 is controlled by the high strength first and second base plates 32, 34 (stronger components) which remain within the elastic range of the A514 steel first and second base plates 32, 34 at all times. The shape of the bearing area 44 between the compressible member 30 and the first base plate 32 and the second base plate 34 is substantially a circular segment defined by a secant and the compressible member 30 perimeter. The size of the bearing area 44 is directly dependent on the magnitude of the column reaction. The bearing stress is zero on the secant (heel) and the cold formed area starts on a line parallel to the secant at a point where the bearing stress equals the compressible member yield stress and continues to the edge of the compressible member 30 (toe) where the stress is at a maximum level.

The entire compressible member 30 area (minus the cold formed annulus which is conservatively assumed to be three hundred and sixty (360°) degrees of damage) supports the column reaction elastically up to and beyond incipient rocking until the compressible member yield stress has been reached in the toe area. The bearing area 44 is minimized when the hinge rotation angle has been maximized. At this point, the stress at the edge of the compressible member 30 is assumed to be equal to the ultimate stress for the compressible member material.

In a preferred embodiment, as illustrated in FIGS. 1-3, the outer perimeter of the compressible member 30 is free from any attachment, or otherwise floats between the first base plate 32 and the second base plate 34. In other embodiments, as illustrated in FIGS. 5 and 6, the compressible member 30 serves as the pintle member 40 to inhibit rolling of the first base plate 32 relative to the second base plate 34 and to inhibit lateral movement of the first base plate 32 relative to the second base plate 34.

Figure 5:
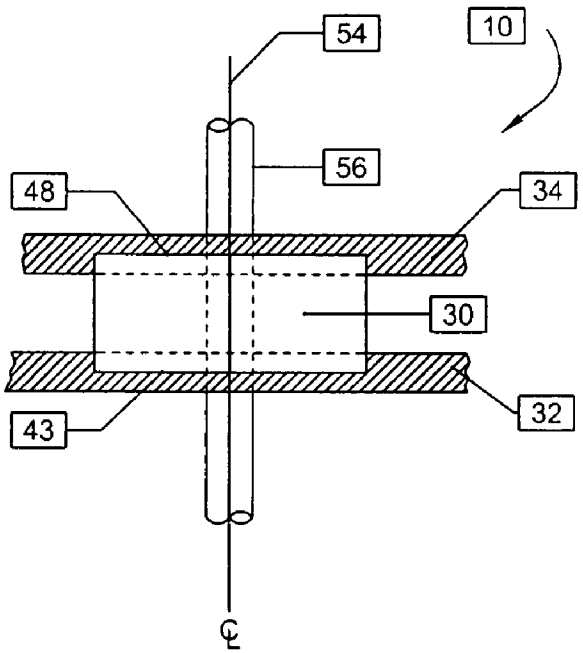
FIG. 5 is an elevation view illustrating another embodiment of the rocking hinge bearing system, constructed in accordance with the present invention.

As illustrated in FIG. 5, the first base plate 32 has a first recessed area 43 and the second base plate 34 has a second recessed area 48 with at least a portion of the compressible member 30 being receivable within the first recessed area 43 and at least another portion of the compressible member 30 being receivable within the second recessed area 48. As with the preferred embodiment, the compressible member 30 floats between the first base plate 32 and the second base plate 34 within the first recessed area 42 43 and the second recessed area 48. By splitting the compressible member 30, the compressible member 30 can be removed for repair and or replacement without removal of the base plates 32, 34 or other components of the rocking hinge bearing 10.

Figure 6:
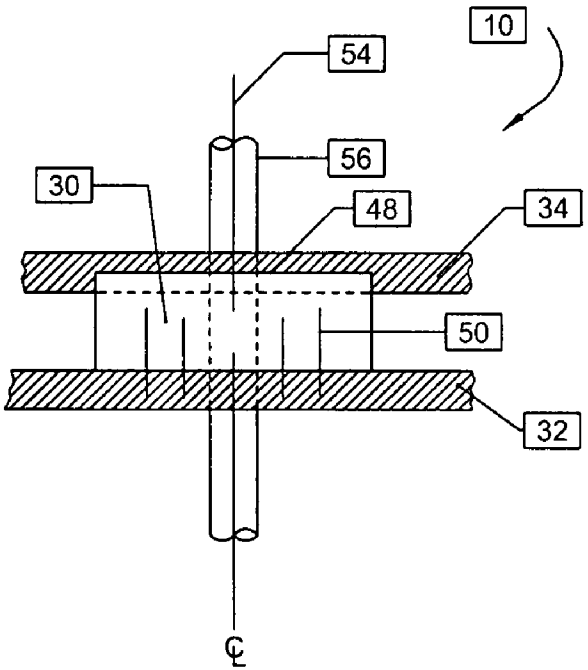
FIG. 6 is an elevation view illustrating still another embodiment of the rocking hinge bearing system, constructed in accordance with the present invention.

As illustrated in FIG. 6, the second base plate 34 includes the second recessed area 48 with at least a portion of the compressible member 30 receivable within the second recessed area 48; the first base plate 32 being free from any recessed areas. At least one fastening mechanism 50, i.e., screw, bolt, etc., secures the compressible member to the first base plate 32 to inhibit lateral movement of the compressible member 30 relative to the first base plate 32 and the second base plate 34.

Figure 7:
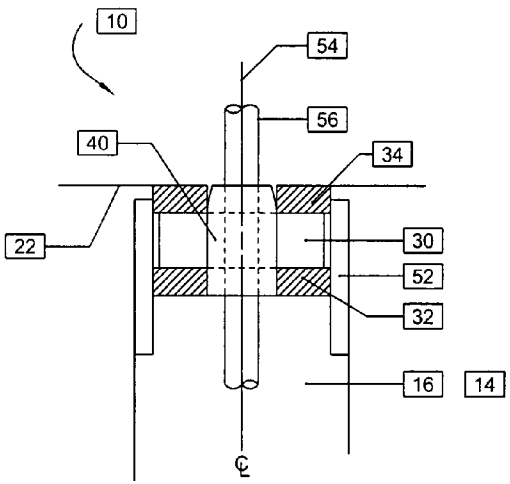
FIG. 7 is an elevation view illustrating yet another embodiment of the rocking hinge bearing system, constructed in accordance with the present invention.

In still another embodiment of the present invention, in order to assist the pintle member 40 in inhibiting the first base plate 32 and the second base plate 34 from moving in a substantially lateral direction relative to each other, an annular ring 52, as illustrated in FIG. 7 can be secured about the first base plate 32 and column 16 or caisson (foundation) 14 to confine the second base plate 34, and the compressible member 30. In other words, the annular ring 52 provides additional lateral resistance thereby reducing the size requirement of the pintle member 40.

Most of the time the actual weight of the structure 12 will cause the rocking hinge bearing assembly 10 to return to its original position. However, there is a rocking column position beyond which the weight of the structure 12 will actually cause the structural system to collapse. For this reason, post tensioning is needed to cause the structure 12 to return to its original position after the structure 12 has rocked out of plumb. Therefore, the rocking hinge bearing 10 of the present invention further includes a cable 54 extending through the pintle member 40 and secured within the structure 12 at each end. The cable 54 provides post tensioning to the rocking hinge bearing 10 to cause the structure 12 to return to its original position after rocking.

Figure 8:
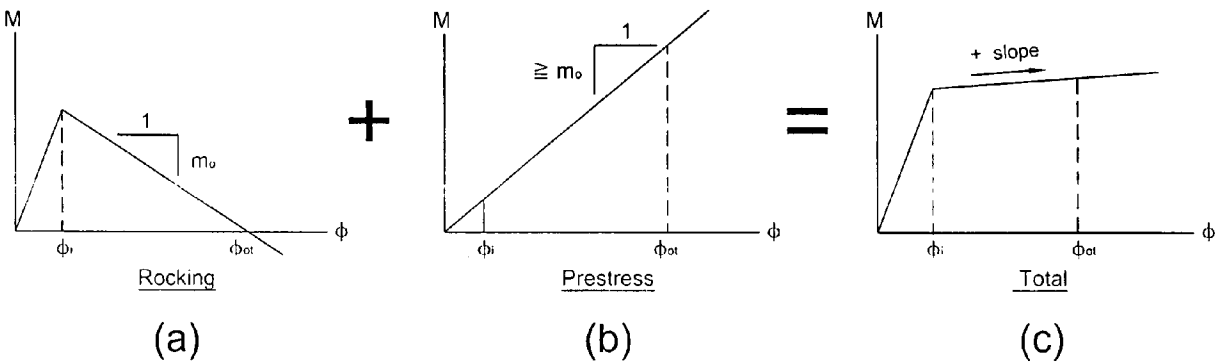
FIGS. 8*a*, 8*b*, and 8*c* are graphs illustrating (a) a rocking plot of the moment (M) versus the angle (ϕ) without prestressing, (b) a prestressing plot of the moment (M) versus the angle (ϕ), and (c) the total plot of rocking and prestress indicating a zero or positive slope.

As illustrated in FIGS. 8*a*-8*c*, the amount of the post-tensioning force to be applied to the rocking hinge bearing 10 by the cable 54 is determined by the moment created by the applied horizontal force which is equal to the applied horizontal force times the height of the rocking column 16 or 24 that produces moment in the rocking hinge bearing 10. As illustrated in FIG. 8*a*, a plot of this moment (M) versus the rocking column rotation angle ($\phi$) is called a rocking plot. Incipient rotational instability occurs at the point where M=0. Negative values of M indicate that the direction of the applied horizontal force must be reversed in order to prevent the structure 12 from falling over (collapsing). With prestressing, as illustrated in FIG. 8*b*, the cable 54 stretches as the structure 12 translates horizontally under horizontal loading creating another M/$\phi$ diagram called the prestressing plot. The cable 54 is sized and determined to have sufficient strength such that the superposition of the rocking and prestressing diagrams creates a total diagram, as illustrated in FIG. 8*c*, with a zero or positive slope. This system insures that gravity alone will not be able to topple or otherwise cause the structure 12 to collapse under lateral loading.

The prestressing cable 54 could be a conventional prestressing tendon, a steel cable, a steel bar, or a fiber-reinforced plastic cable. A sleeve 56, such as a steel pipe, can be mounted within the pintle member 40 encasing the cable 54 to allow free movement of the cable 54 within the pintle member 40, caisson (foundation) 14, columns 16 and 24 and cap beam 22. It should be noted that there can be a plurality of cables 54, with each cable 54 extending through one of the pintle members 40 or there can be a single cable 54 extending through all aligned pintle members 40 in the structure 12. The M/$\phi$ ductility requirements, i.e., the maximum needed $\phi$ value to resist the design dynamic event without breaking, determines the required length for each cable 54.

Rolling is typically caused when the dynamically induced lateral force is not directed toward the center of the rocking hinge bearing 10; the pintle 40 prevents this action. The prestressing force prevents instability during rocking and can be sized to limit the moment developed during rocking. The circular compressible member 30 offers equal overturning (flexural) resistance in all directions and the magnitude of the initial prestress force of the cable 54 along with the diameter of the compression member 30 can be selected to produce a desired moment resistance before rocking begins.

However, it is not absolutely necessary for the prestressing force of the cable 54 to be applied on the center of the rocking hinge bearing 10; the prestressing force could be applied by locating at least one cable 54 elsewhere on or around the perimeter of the compressible member 30 to best match the anticipated flexural requirements. As discussed above, the pintle member 40 could be replaced or supplemented with different restraining devices to prevent a relative lateral displacement or rolling action from occurring between the first base plate 32 and the second base plate 34.

By use of the pintle member 40, the compressible member 30 and the prestressed cable 54, the rocking hinge bearing 10 of the present invention employs a prestress righting force to inhibit collapse of the structure 12 during rocking; no other conventional isolation device works in this manner.

The rocking hinge bearing 10 of the present invention is a moment limiting governor. Each end of a column can be fitted with a rocking hinge bearing 10 to create flexible (soft) column supports that are capable of ducking large horizontal loads by limiting the maximum moment and associated shear produced in a rocking column 16 or 24 by a horizontal acceleration and its associated motion. To some extent, conservation of energy requires the column relative horizontal motion to be increased when the column moments and shears are decreased.

The moment-to-rotation relationship in a rocking hinge bearing 10 is related to the strain in the prestressing cable 54 and is inversely proportional to the cable free (unbonded) length. Hence, the moment developed per radian of rotation will be greater for a cable with a shorter free length. This principle can be used to control the slope of the total diagram in FIG. 8*c*.

The magnitude of column moments and shears during a dynamic event can be controlled by limiting the joint moments during rocking. Accordingly, the maximum column body and cap beam stresses are established by the limiting moments in the rocking hinge bearings 10 and are therefore independent of the magnitude of the actual dynamic event. Of course, the internal rocking hinge bearing stresses are directly proportional to the size of the dynamic event and will reach failure if the event is large enough to exceed its ductility limit. Hence, bent horizontal translations are dependent on the size of the event and are directly related to the ductility (inelastic movement without failure) of the rocking-hinge bearings 10. The ductility of a rocking hinge bearing 10 is controlled by the amount of rotation the joint can develop without crushing the compressible member 30 beyond its useful limits.

Columns fitted with rocking hinge bearings 10 isolate the elevated portions (superstructures) of bridges, buildings, and other structures from ground motions produced by dynamic loads. During a dynamic event, the rocking hinge bearing 10 equipped columns convert high frequency, low amplitude jolting motions from the dynamic load to a low frequency, high amplitude swaying motion in the superstructure. The structure 12 remains stable with no significant damage throughout the event.

CONCLUSION

The invention is a bearing that is used to control the moment transfer at each end of a load bearing column when it is rocked back and forth by a laterally applied load such as the load produced during a dynamic event. The bearing consists of a compressible member of any strategic shape (circular, elliptical, etc.) that is sandwiched between upper and lower base plates. The relative position of the sandwiched members is maintained with a hollow pintle that is inserted perpendicular to the plane of each member on an axis that is parallel to the column's vertical axis and is congruent with the column's vertical axis in the preferred embodiment. Post-tensioning is provided by a prestressing cable that passes through the hole in the pintle to secure each end of the column to its supports. The size of the post-tensioning force and the size of the compressible member interface at the base plates controls the moment transfer across the joint. The length of the prestressing cable determines how rapidly the moment transfer builds up with the lateral displacement created by the column rocking action. The ability to gradually build moment transfer without breaking is known as ductility which has become an important tool for providing dynamic resistance in modern construction. The combined forces provided by post-tensioning and the axial load supported by the column have a natural and beneficial tendency to recenter the column after rocking thus maintaining the original column-to-support geometry.

Longer columns supported on rock like foundations and fitted with rocking hinge bearings appear to perform better than their plastic hinge or lead-rubber counterparts.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A rocking bearing assembly for supporting a structure, the structure having a first support in a first position relative to a second support in a second position, the bearing assembly comprising:

a first base plate mounted to the first support of the structure, the first base plate having a first aperture;

a second base plate mounted to the second support of the structure, the second base plate having a second aperture, the first aperture alignable with the second aperture;

a first compressible member positioned between the first and second base plates, the first compressible member having a compressible member aperture alignable with the first aperture and the second aperture;

a pintle member having a pintle aperture, the pintle member mounted within the first aperture, the second aperture, and the compressible member aperture; and tensioning means extending through the pintle aperture for tensioning the first support to the second support in the first position;

wherein upon rocking movement of the first support relative to the second support, the first support returns to the first position and the second support returns to the second position; and wherein the rocking bearing assembly is configured such that there is no relative horizontal movement between the first and second base plates.

2. The bearing assembly of claim 1 wherein the first base plate and the second base plate are constructed from a first material and the first compressible member is constructed from a second material, the second material deforming at a lower load than the first material.

3. The bearing assembly of claim 1 wherein the first compressible member is free from attachment to the first base plate and the second base plate.

4. The bearing assembly of claim 1 wherein the compressible member includes a first compressible portion and a second compressible portion.

5. The bearing assembly of claim 1 wherein the tensioning means is constructed from a material which resists tension and is elastic having a predetermined proportional limit.

6. The bearing assembly of claim 1 wherein the pintle member is secured to the first base plate by a securement selected from the group consisting of a press-fit, threads, and welding.

7. The bearing assembly of claim 1 wherein the pintle member has a tapered portion nearingly adjacent the second base plate.

8. The bearing assembly of claim 1 wherein the structure is selected from the group consisting of bollards, buildings, bridges, structural frames, walls, towers, and antennas.

9. The bearing assembly of claim 1 wherein the first support supports the second support, and further comprising:

at least one support supported by the second support;

at least one base plate mounted to each support of the structure;

a compressible member positioned between the base plates of adjacent supports;

a pintle member mounted within the compressible member and the base plates of adjacent supports, the pintle member inhibiting relative horizontal motions between each support and the base plate; and tensioning means extending through the pintle member for tensioning each support to an adjacent support;

wherein upon rocking movement of each support relative to the adjacent support, each support returns to an initial position.

10. The bearing assembly of claim 9 wherein the tensioning means comprises one or more cables extending through one or more rocking hinge bearings.

11. The bearing assembly of claim 1 wherein the tensioning means has a first end and a second end, the first end secured to the first support and the second end secured to the second support.

12. A rocking bearing assembly for supporting a structure, the structure having a first support in a first position relative to a second support in a second position, the bearing assembly comprising:

a first base plate mounted to the first support of the structure, the first base plate having a first aperture;

a second base plate mounted to the second support of the structure, the second base plate having a second aperture, the first aperture alignable with the second aperture;

a first compressible member positioned between the first and second base plates, the first compressible member having a compressible member aperture alignable with the first aperture and the second aperture;

a pintle member having a pintle aperture, the pintle member mounted within the first aperture, the second aperture, and the compressible member aperture; and tensioning means extending through the pintle aperture for tensioning the first support to the second support in the first position;

wherein upon rocking movement of the first support relative to the second support, the first support returns to the first position and the second support returns to the second position; and wherein the rocking bearing assembly is configured to allow primarily relative rocking movement between the first and second base plates without any relative horizontal movement between the first and second base plates.

* * * * *